US010502515B2

(12) United States Patent
Sowers et al.

(10) Patent No.: US 10,502,515 B2
(45) Date of Patent: Dec. 10, 2019

(54) LAUNCH PISTON BRAKE

(71) Applicant: Raytheon Company, Waltham, MA (US)

(72) Inventors: Jeffery P. Sowers, Sahuarita, AZ (US); Matthew B. Castor, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 192 days.

(21) Appl. No.: 15/407,349

(22) Filed: Jan. 17, 2017

(65) Prior Publication Data

US 2018/0245874 A1 Aug. 30, 2018

(51) Int. Cl.

| | |
|---|---|
| ***F41A 21/46*** | (2006.01) |
| ***F41A 21/32*** | (2006.01) |
| ***F41F 1/06*** | (2006.01) |
| ***F41F 1/08*** | (2006.01) |
| ***F41F 3/073*** | (2006.01) |
| ***F41B 11/73*** | (2013.01) |
| ***F41A 21/16*** | (2006.01) |

(52) U.S. Cl.

CPC ..... *F41A 21/46* (2013.01); *F41A 21/16* (2013.01); *F41A 21/32* (2013.01); *F41B 11/73* (2013.01); *F41F 1/06* (2013.01); *F41F 1/08* (2013.01); *F41F 3/073* (2013.01)

(58) Field of Classification Search

CPC ..... F41A 21/46; F41A 21/16; F41A 21/32; F41B 11/73; F41F 1/06; F41F 1/08; F41F 3/073

USPC ..... 89/14.6

See application file for complete search history.

(56) References Cited

U.S. PATENT DOCUMENTS

| | | | | |
|---|---|---|---|---|
| 29,272 A * | 7/1860 | Hotchkiss | F42B 14/02 | 102/525 |
| 126,058 A * | 4/1872 | Hubbell | F42B 14/064 | 102/522 |
| 422,347 A * | 2/1890 | Hyde | F41B 11/00 | 124/60 |

(Continued)

FOREIGN PATENT DOCUMENTS

| | | |
|---|---|---|
| DE | 35 03 040 A1 | 7/1986 |
| DE | 39 39 037 A1 | 5/1991 |
| FR | 1 603 316 A | 4/1971 |

OTHER PUBLICATIONS

International Search Report and Written Opinion for corresponding International Application No. PCT/US2017/051048 dated Jul. 4, 2018.

*Primary Examiner* — Michelle Clement

(74) *Attorney, Agent, or Firm* — Renner, Otto, Boisselle & Sklar, LLP

(57) ABSTRACT

A launcher for launching a projectile includes a launch piston for engaging and driving the projectile from the launcher and a launch brake that constrains the piston to enable separation of the piston from the projectile. The launch brake is configured to have minimal to no effect on projectile exit velocity and exit trajectory from the launcher. The launch brake is also configured to reduce the velocity of the launch piston via coupling of the masses of the launch piston and the launch brake. The coupling allows, separation of the projectile from the launch piston and reduces or prevents a negative effect on stabilization of the projectile upon exit from the launcher.

16 Claims, 3 Drawing Sheets

(56) References Cited

U.S. PATENT DOCUMENTS 478,020 A * 6/1892 Pollard ..... F41A 21/28 89/14.05
620,400 A * 2/1899 Ahrens ..... F42B 14/064 102/522
868,938 A * 10/1907 Puff ..... F41A 21/18 102/526
1,416,827 A * 5/1922 Holmes ..... F41A 1/00 42/106
1,416,828 A * 5/1922 Holmes ..... F42B 14/06 102/430
2,064,503 A * 12/1936 Temple, Jr. ..... B25C 1/16 102/531
2,115,028 A * 4/1938 Logan ..... F41A 21/46 102/526
2,306,140 A * 12/1942 Reed ..... F42B 10/42 102/522
2,315,207 A * 3/1943 Frantisek ..... F41A 21/46 102/518
2,382,152 A * 8/1945 Jakobsson ..... F42B 14/064 102/523
2,672,814 A * 3/1954 Dubost ..... E21B 43/116 102/523
2,811,901 A * 11/1957 Barr ..... F41A 21/46 102/521
2,991,720 A * 7/1961 Dunlap ..... F42B 14/064 102/523
2,992,612 A * 7/1961 Critchfield ..... F42B 14/064 102/522
3,011,404 A * 12/1961 Russell ..... F41A 1/04 102/431
3,011,407 A * 12/1961 Koningsveld ..... F41A 3/22 102/520
3,015,991 A * 1/1962 Forbes, Jr. ..... F41F 3/048 102/377
3,055,268 A * 9/1962 Rosenthal ..... F41A 1/08 102/522
3,089,388 A * 5/1963 Webster ..... F41F 3/04 102/522
3,138,991 A * 6/1964 Malter ..... F41A 21/36 102/506
3,158,124 A * 11/1964 Chevillon ..... F41F 3/07 114/21.1
3,242,866 A * 3/1966 Malter ..... F41A 21/46 102/506
3,270,618 A * 9/1966 Stott ..... F41A 1/08 102/522
3,279,319 A * 10/1966 Semonian ..... F41A 1/10 89/1.701
3,340,769 A * 9/1967 Waser ..... F41A 21/28 42/76.01
3,349,712 A * 10/1967 Schwager ..... F42B 14/064 102/522
3,359,905 A * 12/1967 Engel ..... F42B 14/064 102/522
3,392,472 A * 7/1968 Barr ..... F41A 21/46 102/521
3,400,661 A * 9/1968 Coon ..... F41A 21/46 102/522
3,427,648 A * 2/1969 Manning ..... F41A 21/46 102/523
3,431,815 A * 3/1969 Kaufmann, Jr. ..... F42B 14/08 102/522
3,476,048 A * 11/1969 Barr ..... A01K 81/00 102/399
3,490,330 A * 1/1970 Walther ..... F41A 1/08 89/1.7
3,499,364 A * 3/1970 Ooge ..... F41F 3/07 89/1.81
3,551,972 A * 1/1971 Engel ..... F42B 12/38 102/513
3,745,926 A * 7/1973 Mertz ..... F42B 10/08 102/523
3,762,279 A * 10/1973 Zeyher ..... F16F 7/12 92/85 R
3,771,417 A * 11/1973 Schnabele ..... F41A 1/08 89/1.701
3,861,271 A * 1/1975 Osborn, Jr. ..... F41F 3/077 89/1.8
3,905,299 A * 9/1975 Feldmann ..... F42B 14/064 102/522
4,022,103 A * 5/1977 Schmidt ..... F41A 21/46 89/14.2
4,040,331 A * 8/1977 Litman ..... F41A 21/46 102/515
4,043,269 A * 8/1977 Ambrosini ..... F42B 12/38 102/513
4,126,955 A * 11/1978 Coffield, Jr. ..... F41A 21/16 102/430
4,132,148 A * 1/1979 Meistring ..... F41A 1/10 89/1.701
4,148,244 A * 4/1979 Schnabele ..... F41A 1/08 188/371
4,296,687 A * 10/1981 Garrett ..... F42B 14/064 102/518
4,314,510 A * 2/1982 Jeter ..... F42B 14/064 102/521
4,385,561 A * 5/1983 Madderra ..... F42B 14/06 102/523
4,413,565 A * 11/1983 Matthey ..... F42B 10/34 102/503
4,434,718 A * 3/1984 Kopsch ..... F42B 14/064 102/439
4,450,770 A * 5/1984 Kirkendall ..... F42B 14/061 102/523
4,464,972 A * 8/1984 Simon ..... F16J 3/06 277/585
4,497,239 A * 2/1985 Curry ..... F41A 19/26 102/432
4,505,204 A * 3/1985 Wikstrom ..... F42B 14/064 102/523
4,519,317 A * 5/1985 Rosenberg ..... F42B 14/061 102/521
4,553,480 A * 11/1985 McLellan ..... F42B 29/00 102/430
4,590,862 A * 5/1986 Grabarek ..... F42B 14/064 102/522
4,616,554 A * 10/1986 Spink ..... F41F 3/052 89/1.806
4,653,404 A * 3/1987 Halverson ..... F42B 14/068 102/520
4,709,638 A * 12/1987 Broden ..... F42B 14/068 102/522
H405 H * 1/1988 Covey ..... 102/520
4,733,612 A * 3/1988 Sigg ..... F42B 14/061 102/511
4,735,148 A * 4/1988 Holtzman ..... F42B 14/064 102/522
4,753,152 A * 6/1988 Baechler ..... F41A 1/08 188/371
4,756,226 A * 7/1988 Piesik ..... F41F 3/0413 102/520
4,796,510 A * 1/1989 Piesik ..... F41F 3/0413 89/1.8
4,881,466 A * 11/1989 McGinley ..... F42B 14/064 102/522
4,936,219 A * 6/1990 Mudd ..... F42B 10/06 102/520
5,105,713 A * 4/1992 Wirgau ..... F42B 6/006 102/517
5,157,224 A * 10/1992 Desevaux ..... F42B 5/045 102/430
5,168,119 A * 12/1992 Sands ..... F41F 3/052 89/1.51
5,189,254 A * 2/1993 Berville ..... F42B 14/067 102/439
5,239,930 A * 8/1993 Adam ..... F42B 14/06 102/522

(56) References Cited

U.S. PATENT DOCUMENTS 5,398,588 A * 3/1995 Peck ..... F41F 3/052 89/1.806
5,452,535 A * 9/1995 See ..... F41A 21/40 42/79
5,623,113 A * 4/1997 Valembois ..... F41H 9/08 102/340
5,804,759 A * 9/1998 Sauvestre ..... F42B 7/10 102/439
5,918,307 A * 6/1999 Cipolla ..... F41F 3/10 114/238
6,170,477 B1 * 1/2001 Horlock ..... F41B 11/83 124/61
6,371,002 B1 * 4/2002 MacLeod ..... F41F 3/04 89/1.81
6,502,516 B1 * 1/2003 Kinchin ..... F42B 7/08 102/439
6,502,528 B1 * 1/2003 MacLeod ..... F41F 3/10 114/238
6,516,698 B1 * 2/2003 Poff, Jr. ..... F41A 21/36 89/14.6
6,568,309 B2 * 5/2003 MacLeod ..... F41F 3/04 89/1.81
6,575,098 B2 * 6/2003 Hsiung ..... F42B 5/02 102/498
6,776,079 B1 * 8/2004 Barker ..... F41F 3/08 114/238
7,377,204 B2 * 5/2008 Simmons ..... F41A 1/02 102/522
7,380,505 B1 * 6/2008 Shiery ..... F42B 12/34 102/501
7,430,825 B2 * 10/2008 Vanek ..... F41A 1/00 102/503
7,681,504 B2 * 3/2010 Machina ..... F42B 10/06 102/501
7,934,456 B1 * 5/2011 Heitmann ..... F42B 14/067 102/520
7,987,790 B1 * 8/2011 Scarr ..... F42B 5/025 102/502
7,997,224 B2 * 8/2011 Owen ..... F41F 3/10 114/238
8,037,830 B2 * 10/2011 Winter ..... F42B 7/10 102/470
8,276,305 B1 * 10/2012 Leutenegger ..... F41A 21/40 42/1.06
8,353,239 B1 * 1/2013 Patel ..... F41F 3/0413 89/1.819
8,640,625 B1 * 2/2014 Wong ..... F42B 8/14 102/444
8,887,641 B1 * 11/2014 Manole ..... F42B 14/06 102/521
10,151,555 B1 * 12/2018 Matson ..... F41B 11/62
2003/0089221 A1 * 5/2003 O'Dwyer ..... F41A 21/46 89/14.6
2003/0167957 A1 * 9/2003 Heitmann ..... F42B 14/02 102/521
2003/0167958 A1 * 9/2003 Johansson ..... F42B 14/064 102/522
2004/0031381 A1 * 2/2004 Williams ..... F41F 3/07 89/1.809
2004/0149157 A1 * 8/2004 Hellman ..... F42B 14/02 102/524
2005/0188891 A1 * 9/2005 Heitmann ..... F42B 14/061 102/523
2006/0011092 A1 * 1/2006 Mochak ..... F41A 9/28 102/522
2006/0107828 A1 * 5/2006 Veitch ..... F41F 3/04 89/1.809
2006/0162606 A1 * 7/2006 Meyer ..... F41A 21/10 102/521
2008/0148927 A1 * 6/2008 Alberding ..... F41B 11/00 89/1.817
2008/0257192 A1 * 10/2008 Schaeffer ..... F42B 5/035 102/438
2010/0000439 A1 * 1/2010 Baumann ..... F42B 5/18 102/521
2010/0077934 A1 * 4/2010 Heitmann ..... F42B 14/064 102/523
2010/0095863 A1 * 4/2010 Kolnik ..... F42B 5/02 102/502
2010/0282055 A1 * 11/2010 Jansson ..... F41F 3/077 89/1.817
2011/0146525 A1 * 6/2011 Caillat ..... F42B 14/064 102/521
2011/0197780 A1 * 8/2011 Heitmann ..... F42B 14/064 102/522
2011/0214582 A1 * 9/2011 Glasser ..... F42B 12/44 102/439
2014/0190364 A1 * 7/2014 Peterson ..... F42B 7/08 102/439
2015/0267996 A1 * 9/2015 Su ..... B64C 39/024 89/1.816
2016/0178317 A1 * 6/2016 Powell ..... F41F 3/07 89/1.81

* cited by examiner

LAUNCH PISTON BRAKE

GOVERNMENT LICENSE RIGHTS

This invention was made with government support under contract H94003-04-D-0006 awarded by the United States Department of Defense. The government has certain rights in the invention.

FIELD OF THE INVENTION

The invention relates generally to a launch piston brake, and more particularly to a launch piston brake for separating a launch piston from a projectile that is driven by the launch piston.

DESCRIPTION OF THE RELATED ART

A launcher for a projectile often includes a launch tube for supporting and directing the projectile during launch and a piston for driving the projectile from the launch tube. The projectile may be a missile, mortar round, unmanned aerial vehicle, supply container, satellite, etc. Such projectile launched by a piston is often caused to have a skewed trajectory, an undesired velocity component or even a failed launch due to the piston maintaining engagement with the projectile even after the projectile has exited the launch tube. The maintained engagement results in mass being temporarily added to the projectile, changing the center of mass of the projectile and/or imparting an undesired velocity component to the projectile, and thus leading to the inability of the projectile to stabilize upon exit from the launcher resulting in flight failure.

SUMMARY OF THE INVENTION

An exemplary launcher for launching a projectile includes a piston for engaging and driving the projectile from the launcher and a launch brake for engaging the piston to enable separation of the piston from the projectile.

An exemplary launch brake is configured to have minimal to no effect on projectile exit velocity and trajectory from the launcher and to constrain the piston of the launcher that engages and drives the projectile, thereby allowing separation of the projectile from the piston. In this way, the piston does not negatively affect stabilization of the projectile upon exit from the launcher. A launcher provided by the present disclosure may include the launch brake, the piston, and a launch tube for retaining the piston and projectile until launch. The launch brake is configured to be coupled relative to the launch tube. The launcher may further include a power system for driving movement of the piston in the launch tube.

According to one aspect, a launcher for launching a projectile includes a launch tube that directs and supports the projectile during launching, a piston that engages and drives the projectile from the launch tube, and a launch brake that constrains the piston to enable separation of the piston from the projectile.

The launch brake may be configured to allow the projectile to pass the launch brake and to retain the piston.

The launch brake may be positioned to constrain the piston externally to the launch tube.

The launch brake may include a bore having a tapered section that receives and constrains the piston.

The launch brake may include an inner sleeve portion that is configured to deform in response to impact of the piston to constrain the piston therein.

The launch brake may include a bore having radially outwardly extending channels for allowing passage of members extending radially outwardly from an outer profile of the projectile.

The launch brake may be disposed at an outlet end of the launch tube.

The launch brake may be coupled external to the launch tube at a distal end of the launch tube.

The launch brake may be coupled relative to the launch tube via fasteners made of nylon.

The launcher may further include a power system for causing movement of the piston in the launch tube.

The launch brake may be configured to jointly break away from the remainder of the launcher with the piston retained therein.

According to another aspect, a launcher for launching a projectile includes a launch tube configured to support the projectile during launch and to direct the projectile from the launch tube, a piston configured to drive the projectile from the launch tube, and a launch brake configured to reduce the velocity of the piston to separate the piston from the projectile.

The launch brake may be configured to restrain the piston to prevent continued engagement of the piston with the projectile.

The launch brake may be shaped to allow the projectile to pass therethrough.

The launch brake may be configured to jointly break away from the remainder of the launcher with the piston retained therein.

The launch brake may include a bore having radially outwardly extending channels for allowing passage of members extending radially outwardly from an outer profile of the projectile.

According to yet another aspect, a launch brake for coupling relative to a launch tube and for preventing continued attachment of a piston of the launcher with a projectile launched from the launcher includes an inner sleeve having an inner annular wall defining a bore having a tapered section extending between a larger proximal end and a smaller distal end, the inner annular wall for constraining the piston, wherein the inner sleeve is deformable in response to contact with the piston to assist in constraining the piston, and an outer sleeve disposed radially outward of the inner sleeve and supporting the inner sleeve.

The smallest inner diameter of the tapered section may be smaller than the smallest outer diameter of the piston.

The bore may have radially outwardly extending channels for allowing passage of members extending radially outwardly from an outer profile of the projectile.

The launch brake may be configured to fully retain the piston therein to reduce damage to the opposite longitudinal ends of the piston.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

The annexed drawings, which are not necessarily to scale, show various aspects of the disclosure.

DETAILED DESCRIPTION

The present disclosure provides a launcher for launching a projectile using an actuated piston. The projectile launched may be any suitable projectile, such as a missile, mortar round, unmanned aerial vehicle, supply container, satellite, etc. The launcher includes a launch brake that constrains the piston used to drive the projectile from the launcher, thereby enabling separation of the piston from the projectile. By providing for separation of the piston from the projectile as the projectile is exiting the launcher, the projectile can stabilize absent the added attached mass of the piston. The launch brake, which may also be referred to as a mass brake, may reduce or altogether prevent launch failures that result from the mass of the piston being added to the mass of the projectile at the exit of the projectile from the launcher. One example of such launch failure is projectile tip-off. As will be appreciated, the launch brake may be used with any suitable launcher using a piston, pusher, etc., for driving a projectile from the launcher. Also, the launch brake may be retrofit onto an existing launcher.

Figure 1:
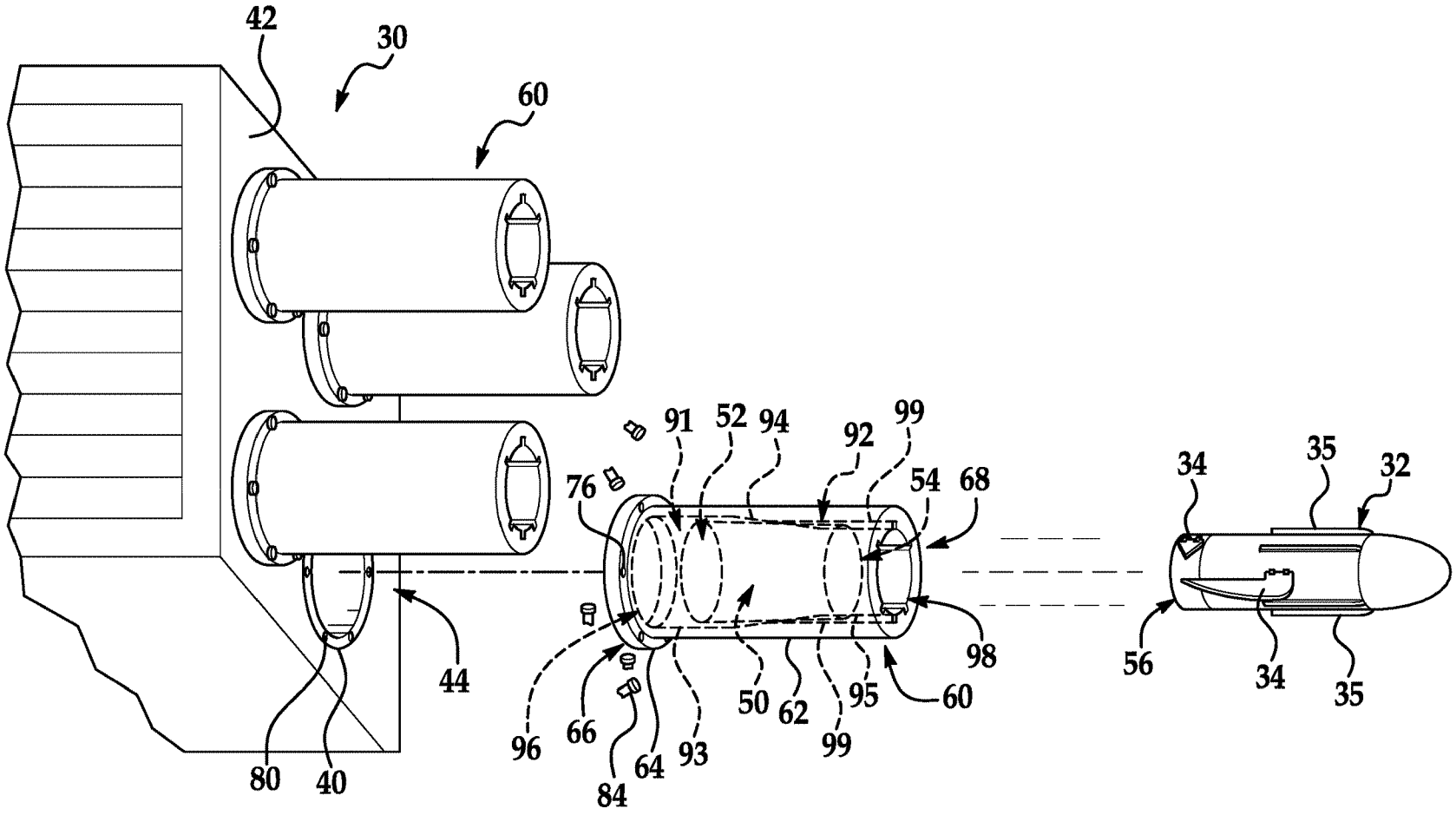
FIG. 1 is an environmental view of a launcher including launch piston brakes according to the present invention, and showing a projectile launched with use of one of the launch piston brakes.

Turning first to FIG. 1, an exemplary launcher is illustrated at 30 for launching a projectile 32, such as an unmanned aerial vehicle (UAV) which may be collapsed. The UAV projectile 32 may have at least one actuatable wing 34 for opening from a collapsed stowed launching position to a launched flight position after exit of the UAV projectile 32 from the launcher 30. As will be appreciated, other types of projectiles may be used with the launcher 30.

The UAV 32 also includes one or more alignment members 35 for aligning the UAV projectile 32 relative to a respective launch tube from which the UAV projectile 32 is launched. As shown, the UAV projectile 32 includes six alignment members 35 that are circumferentially spaced apart from one another. The alignment members 35 extend along the outer profile of the UAV projectile 32 between opposing axial ends of the UAV projectile 32. Each of the alignment members 35 and the stowed actuatable wings 34 extends beyond a largest main outer diameter of the UAV projectile 32. The main outer diameter is defined as the outer diameter of the UAV projectile 32 not taking into account the alignment members 35 and the stowed actuatable wings 34.

The launcher 30 includes at least one launch tube 40 for supporting and launching the at least one UAV projectile 32. As shown, the launcher 30 includes four launch tubes 40 for launching as many projectiles, such as four UAV's. In other embodiments, the launcher 30 may include any suitable number of launch tubes 40, one or more. The launch tube 40 is supported in a launcher body 42 and extends between a proximal launch end 43 (FIG. 4A) and a distal output end 44, disposed opposite the proximal launch end.

The launch tube 40 is configured, such as being adequately shaped, to direct and support the UAV projectile 32 from a stationary launch state to a flight state upon exit from the launch tube 40. The launch tube 40 is shown as being cylindrical, though the launch tube 40 may have any suitable inner profile that corresponds to a respective outer profile of the projectile.

The six alignment members 35 of the UAV projectile 32 brace against the inner profile of the launch tube 40. The launch tube 40 has a larger inner diameter than a largest total outer diameter of the UAV projectile 32 that includes the alignment members 35.

A launch piston 50, also herein referred to as a piston 50, is configured to be initially disposed adjacent the proximal launch end 43 of the launch tube 40 at a state of rest. The launch piston 50 is configured via its profile and construction to engage the launch tube 40 while driving the UAV projectile 32 from the launch tube 40 upon activation of the launch piston 50.

The launch piston 50 has an outer profile that is at least partially cylindrical. The launch piston 50 extends from a proximal driven end 52 that is engaged by a suitable power system 53 (FIG. 4A) to a driving end 54 that is suitably shaped to engage a driven end 56 of the UAV projectile 32. For example, the driven end 52 may have a clocking member (not shown) for aligning or nesting relative to the inner profile of the launch tube 40. The driving end 54 of the launch piston 50 and the driven end 56 of the UAV projectile 32 may partially nest with one another.

The power system 53 for actuating the launch piston 50 may be pneumatic, electrical, mechanical, explosive/pyrotechnic, chemical, or any combination thereof. For example, the power system 53 may be pneumatic and may use compressed gas to rapidly accelerate the launch piston 50 from its state of rest at the proximal end 43 of the launch tube 40 to its final accelerated state at the distal output end 44 of the launch tube 40. In other embodiments, the piston 50 may be driven by a contact component of the power system 53 to which a force from the power system 53 may be applied.

As will be appreciated, the illustrated launch tube 40 is configured to allow the launch piston 50 to exit the launch tube 40 along with the UAV projectile 32. To conserve momentum of the UAV projectile 32, and to reduce or altogether prevent damage to the launch piston 50 and the launch tube 40, the launch piston 50 is enabled to exit from the output end 44 of the launch tube 40. In this way, the launch piston 50 and the launch tube 40 may be reusable in some embodiments.

The launcher 30 further includes a launch brake 60 for interacting with the launch piston 50 at the output end 44. The launch brake 60 prevents the launch piston 50 from remaining engaged with the UAV projectile 32 upon exit of the UAV projectile 32 from the output end 44 of the launch tube 40. As will be described, the launch brake 60 may also serve an additional purpose of enveloping at last a part of or all of the launch piston 50, thereby serving as a protective vessel for the launch piston 50 to allow for reuse of the launch piston 50.

As illustrated, the launcher 30 includes four launch brakes 60 corresponding to the four launch tubes 40. The four launch brakes 60 are shaped and positioned to not interfere with adjacent launch tubes 40, adjacent launch brakes 60 or projectiles 32 launching from the adjacent launch tubes 40.

With respect to enabling separation of the launch piston 50 and the UAV projectile 32, the launch brake 60 is configured for engaging, and preferably for constraining and retaining, the launch piston 50. For example, the launch brake 60 is shaped to allow the UAV projectile 32 to pass through the launch brake 60, but to enable retention of the launch piston 50. The retention prevents continued attachment of the launch piston 50 with the UAV projectile 32 upon or soon after exit from the launcher 30 and thus enables separation of the launch piston 50 from the UAV projectile 32. Further, to account for the momentum of the launch piston 50, the launch brake 60 is configured to jointly break away from the remainder of the launcher 30 with the launch piston 50 at least partially retained therein.

Figure 2:
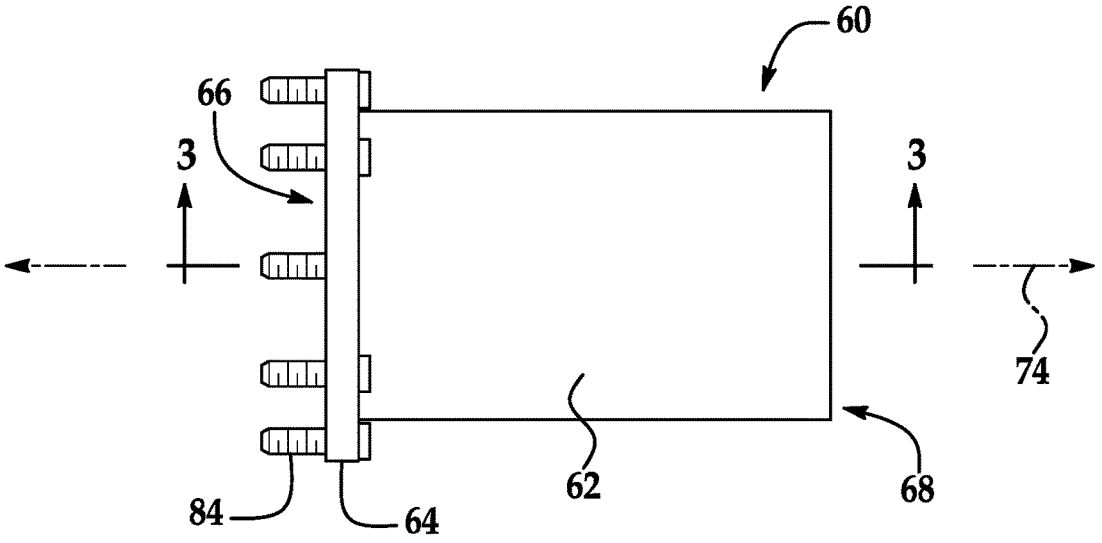
FIG. 2 is an elevated side view of one of the launch piston brakes of FIG. 1.
Figure 3:
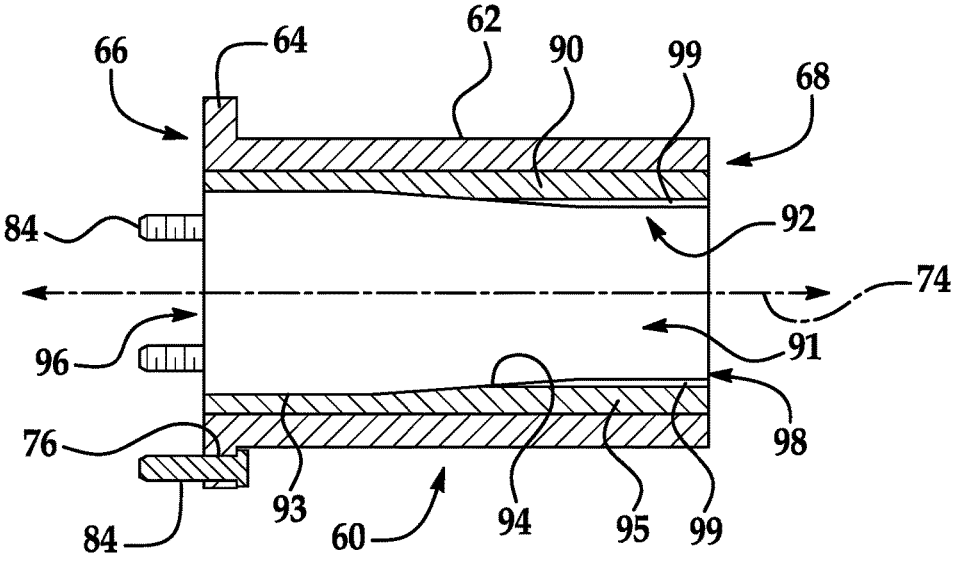
FIG. 3 is an elevated cross-sectioned view of the launch piston brake of FIG. 2.

Turning in addition to FIGS. 2 and 3, the launch brake 60 includes a brake body 62, also herein referred to as an outer sleeve. The brake body 62 extends from a brake flange 64 at a flanged end 66 of the launch brake 60 to an exit end 68 of the launch brake 60. In some embodiments, the brake body 62 may be made of a material providing for strength and stiffness such as aluminum, steel, etc.

The brake flange 64 extends radially outwardly from the brake body 62 and from a launch brake central longitudinal axis 74. As shown, the flange 64 is integral with the remainder of the brake body 62, though may be separate in other embodiments. The brake flange 64 is coupled relative to the launch tube 40. As depicted, the brake flange 64 and launch brake 60 are coupled external to the launch tube 40 at the distal output end 44 of the launch tube 40. More particularly, the depicted brake flange 64 is coupled to the distal output end 44 of the launch tube 40. The illustrated brake flange 64 includes fastener through-holes 76 corresponding to fastener through-holes 80 at the distal output end 44 of the launch tube 40. While five through-holes 76 and 80 are shown, any number suitable for the coupling may be included.

The through-holes 76 and 80 are sized to receive suitable fasteners 84. The illustrated fasteners 84 are threaded fasteners, such as bolts, and thus the through-holes 76 and 80 may be correspondingly threaded. In some embodiments, the fasteners 84 may be made of a material having a low tensile strength as compared to materials of the launch tube 40 and launch brake 60, such as nylon. By breaking before the launch tube 40, such fastener material may reduce or altogether prevent damage to the launch tube 40.

In some embodiments, the fasteners may be snaps or other non-threaded fasteners. In some embodiments, the fasteners may be positioned to break in shear and have low shear strength as compared to materials of the launch tube 40 and launch brake 60.

The launch brake 60 further includes a retaining sleeve 90, also herein referred to as an inner sleeve, that is disposed radially inward of the brake body 62 and of the brake flange 64. The retaining sleeve 90 is circumferentially supported by the brake body 62 and extends between the flanged end 66 and the exit end 68 of the launch brake 60. The retaining sleeve 90 and the brake body 62 may be coupled to one another by any suitable means such as press fit, mechanical fasteners, welding, etc.

The retaining sleeve 90 is shaped to allow the UAV projectile 32 and its one or more alignment members 35 to pass therethrough, while also being configured to retain the distal end 54 of the launch piston 50 via its shape, and in some embodiments via the retaining sleeve 90 being at least partially deformable. Accordingly, the inner profile of the sleeve 90 enables the separation of the launch piston 50, and also may reduce or altogether prevent damage to at least one of the distal end 54 of the launch piston 50 and the proximal end 52 of the launch piston 50.

As illustrated, the launch brake 60, is shaped to retain the full length of the launch piston 50. Each of the distal end 54 and the proximal driven end 52 of the launch piston 50 are contained in the launch brake 60. Thus, the launch brake 60 has a length extending between its flanged end 66 and exit end 68 that is longer than the length of the launch piston 50 extending between its proximal end 52 and distal end 54.

Also as illustrated, the retaining sleeve 90, and thus the launch brake 60, is shaped to circumferentially constrain an outer profile of the launch piston 50. The retaining sleeve 90 includes an inner annular wall 92 extending along an inner profile of the retaining sleeve 90. The inner annular wall 92 defines a bore 91 having a tapered section 94. The tapered section 94 extends along at least part of a length of the retaining sleeve between a larger proximal opening 96 adjacent the flanged end 66 of the launch brake 60 to a smaller distal opening 98 adjacent the exit end 68 of the launch brake 60.

The illustrated tapered section 94 does not extend fully between the flanged end 66 and the exit end 68. Instead, the tapered section 94 is disposed between the flanged end 66 and the exit end 68 with adjacent cylindrical sections 93 and 95 of the annular wall 92 bookending the tapered section 94. The tapered section 94 may extend to the flanged end 66 and/or the exit end 68 in other embodiments. In some embodiments, it will be appreciated that one or both of the cylindrical section 93 and 95 of the annular wall 92 may be omitted.

The tapering of the tapered section 94 is preferably a shallow taper for capturing launch piston 50. For example, the taper angle may be in the range of about 0.5 degrees to about 2.5 degrees, such as about 1.5 degrees.

To retain the launch piston 50, the smallest inner diameter of the tapered section 94 of the bore 91 is smaller than the smallest outer diameter of the launch piston 50. Preferably, the annular wall 92 is tapered to retain the distal end 54 of the launch piston 50 spaced from the exit end 68 of the launch brake 60 and the proximal end 52 of the launch piston 50 spaced from the flanged end 66.

As noted, the retaining sleeve 90 may be configured to deform in response to impact of the launch piston 50. For example, the retaining sleeve 90 may be made of a compliant material, such as ABS plastic, acetal, etc. The deformability provides for a greater than line-to-line engagement of the retaining sleeve 90 and the launch piston 50. Initially, a line-to-line engagement is provided due to the tapered section 94 constraining the outer profile of the cylindrical launch piston 50. Continued impact of the launch piston 50 with the retaining sleeve 90 may cause inelastic deforming of the annular wall 92, thereby retaining the launch piston 50.

It will be appreciated that in some embodiments, the launch piston 50 may not be fully retained in the launch brake 60. For example, the launch brake 60 may not have a length exceeding the length of the launch piston 50. Additionally or alternatively, the tapered section 94 of the bore 91 of the retaining sleeve 90 may be located along the length of the annular wall 92 such that the launch piston 50 is constrained in a position where it is not fully enveloped by the launch brake 60.

To enable clearance of the UAV projectile 32 through the retaining sleeve 90, the retaining sleeve 90 may include one or more channels 99 corresponding to the one or more alignment members 35 of the UAV projectile 32. As shown, the UAV projectile 32 includes the six circumferentially spaced-apart alignment members 35 corresponding with six circumferentially spaced-apart channels 99 of the retaining sleeve 90. The channels 99 extend radially outwardly from the launch brake central longitudinal axis 74 of the launch brake 60. As depicted, the channels extend longitudinally along the launch brake central longitudinal axis 74 of the launch brake 60 along only a portion of the longitudinal extent of the tapered section 94. The channels 99 are shaped to guide rather than retain the alignment members 35.

The smallest inner diameter of the tapered section 94 of the bore 91 is larger than the largest main outer diameter of the UAV projectile 32. Velocity of the UAV projectile 32 is generally not reduced through the tapered section 94, such as via an impeding contact between the UAV projectile 32 and the sleeve 90.

Figure 4A:
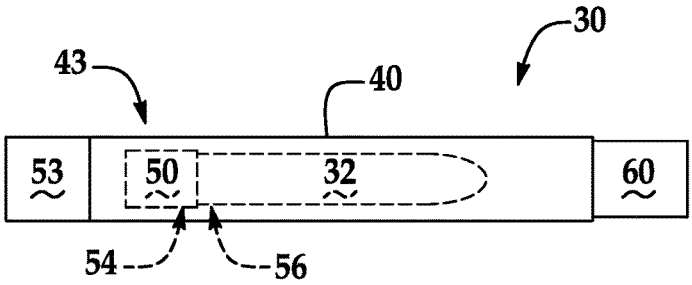
FIG. 4A is a schematic view of a launcher including a projectile and the launch piston brake of FIG. 2, showing the launcher being in a non-activated state.

Turning next to FIGS. 4A-4D, the launcher 30 is schematically illustrated, showing the interactions of the launch tube 40, launch piston 50, UAV projectile 32 and launch brake 60. In FIG. 4A, the launch piston 50 is shown at rest at the launch end 43 of the launch tube 40. The proximal end 56 of the UAV projectile is engaged with the distal end 54 of the launch piston 50.

Figure 4B:
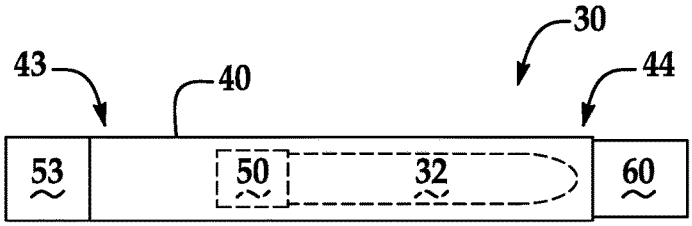
FIG. 4B is another schematic view, showing the launcher having been activated.

Next, looking at FIG. 4B, the launch piston 50 has been activated by the respective power system 53 and is accelerated through the launch tube 40 towards the exit end 44 of the launch tube 40. The UAV projectile 32 is being driven through the launch tube 40 by the launch piston 50.

Figure 4C:
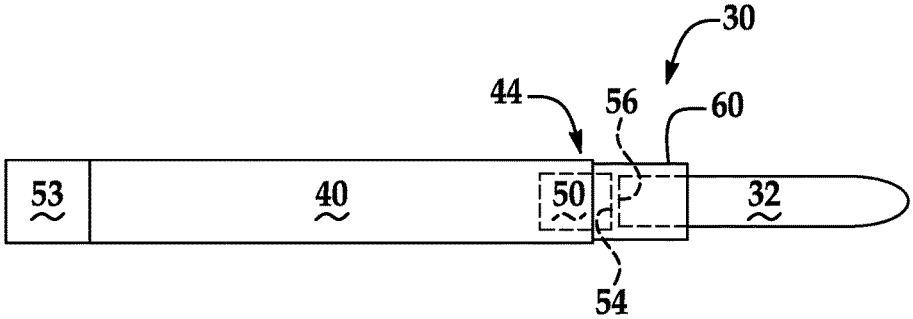
FIG. 4C is a further schematic view, showing the projectile exiting the launch tube of the launcher and the launch piston beginning to be braked by the launch piston brake.

Looking next to FIG. 4C, the UAV projectile 32 moves through the launch brake 60 due to the clearance provided by the tapered section 94 (FIG. 3) of the bore 91. Applying inelastic collision principles, the distal end 54 of the launch piston 50 engages the tapered section 94 such that the launch brake 60 gradually reduces the velocity of the launch piston 50. The engagement includes a deformation of the annular wall 92, enabling a retention of the launch piston 50 by the launch brake 60. A delta velocity is created between the launch piston 50 and the UAV projectile 32 upon or immediately after exit of the UAV projectile 32 from the launch tube 40.

Figure 4D:
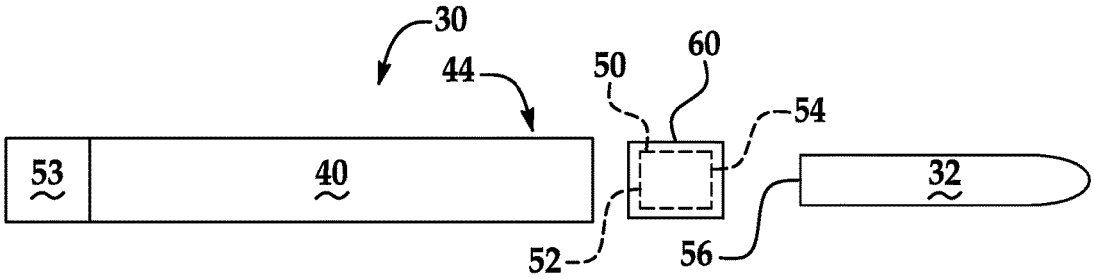
FIG. 4D is yet another schematic view, showing the projectile separated from the launch piston and launch piston brake, and the launch piston engaged with the launch piston brake.

Turning finally to FIG. 4D, the UAV projectile 32 has cleared the launch brake 60 and is separated from the launch piston 50. The UAV projectile 32 is enabled to stabilize its flight upon exit from the launch tube 40.

The launch brake 60 is initially at rest prior to contact by the launch piston 50. Then, the masses of the launch piston 50 and the launch brake 60 are coupled to one another. In one embodiment, the mass of the launch brake 60 is equal to or greater than the mass of the launch piston 50. In another embodiment, the mass of the launch brake 60 is less than the mass of the launch piston 50.

Due to the low tensile force needed to break the fasteners 84 (FIG. 3), the coupled launch brake 60 and launch piston 50 separate from the remainder of the launcher 30, breaking the fasteners 84, and restricting or preventing damage to the exit end 44 of the launch tube 40 and to the distal end 54 and proximal end 52 of the launch piston 50. The distal end 54 of the launch piston 50 and the opposite proximal driven end 52 of the launch piston 50 are each contained in the launch brake 60. Thus, the proximal driven end 52 of the launch piston 50 does not extend from the flanged end 64 of the launch brake 60. Likewise, the distal end 54 of the launch piston 50 does not extend from the exit end 68 of the launch brake 60. This enveloping of the launch piston 50 allows for reuse of the launch piston 50 if warranted.

In summary, the present disclosure provides a launcher 30 for launching a projectile 32. The launcher 30 includes a launch piston 50 for engaging and driving the projectile 32 from the launcher 30 and a launch brake 60 that constrains the launch piston 50 to enable separation of the launch piston 50 from the projectile 32. The launch brake 60 is configured to have minimal to no effect on projectile exit velocity and exit trajectory from the launcher 30. The launch brake 60 is also configured to reduce the velocity of the piston 50 via coupling of the masses of the launch piston 50 and the launch brake 60. The coupling allows separation of the projectile 32 from the launch piston 50 and reduces or prevents a negative effect on stabilization of the projectile 32 upon exit from the launcher 30.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, stores, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A launcher for launching a projectile, the launcher comprising:

a launch tube configured to direct and support the projectile during launching;

a piston configured to engage and drive the projectile from the launch tube; and a launch brake that constrains the piston to enable separation of the piston from the projectile, the launch brake being coupled external to the launch tube via breakable fasteners configured to break during the launching of the projectile.

2. The launcher of claim 1, wherein the launch brake is configured to allow the projectile to pass the launch brake and to retain the piston.

3. The launcher of claim 1, wherein the launch brake is positioned to constrain the piston externally to the launch tube.

4. The launcher of claim 1, wherein the launch brake includes a bore having a tapered section that receives and constrains the piston.

5. The launcher of claim 1, wherein the launch brake includes an inner sleeve portion that is configured to deform in response to impact of the piston to constrain the piston therein.

6. The launcher of claim 1, wherein the launch brake includes a bore having radially outwardly extending channels configured to allow passage of members extending radially outwardly from an outer profile of the projectile.

7. The launcher of claim 1, wherein the launch brake is disposed at an outlet end of the launch tube.

8. The launcher of claim 1, wherein the launch brake is coupled at a distal end of the launch tube.

9. The launcher of claim 1, wherein the breakable fasteners are made of nylon.

10. The launcher of claim 1, wherein the launcher further includes a power system for causing movement of the piston in the launch tube.

11. The launcher of claim 1, wherein the launch brake is configured to jointly break away from the launch tube with the piston retained therein.

12. The launcher of claim 1, wherein the launch brake is shaped to allow the projectile to pass therethrough.

13. The launcher of claim 1, wherein the launch brake includes:

an inner sleeve having an inner annular wall defining a bore having a tapered section extending between a larger proximal end and a smaller distal end, the inner annular wall for constraining the piston, wherein the inner sleeve is deformable in response to contact with the piston to assist in constraining the piston; and an outer sleeve disposed radially outward of the inner sleeve and supporting the inner sleeve.

14. The launcher of claim 13, wherein the smallest inner diameter of the tapered section is smaller than the smallest outer diameter of the piston.

15. The launcher of claim 13, wherein the bore has radially outwardly extending channels configured to allow passage of members extending radially outwardly from an outer profile of the projectile.

16. The launcher of claim 13, wherein the launch brake is configured to fully retain the piston therein to reduce damage to the opposite longitudinal ends of the piston.

* * * * *